US007389790B1

(12) United States Patent
Eley et al.

(10) Patent No.: US 7,389,790 B1
(45) Date of Patent: Jun. 24, 2008

(54) REEL ASSEMBLY

(75) Inventors: Craig Eley, Lincoln, NE (US); Darin L. Schollmeyer, Lincoln, NE (US)

(73) Assignee: Eley Corp., Lincoln, NE (US)

( * ) Notice: Subject to any disclaimer, the term of this patent is extended or adjusted under 35 U.S.C. 154(b) by 215 days.

(21) Appl. No.: 11/343,778

(22) Filed: Jan. 31, 2006

(51) Int. Cl.
*B65H 75/34* (2006.01)

(52) U.S. Cl. ..... 137/355.2; 137/355.26; 242/396.6; 242/406; 242/407.1

(58) Field of Classification Search ..... 137/355.16, 137/355.2, 355.26; 242/396.6, 398, 401, 242/404, 406, 407.1
See application file for complete search history.

(56) References Cited

U.S. PATENT DOCUMENTS 1,819,337 A * 8/1931 Pevear ..... 242/609.2
2,300,243 A * 10/1942 Zierden ..... 242/387
2,334,141 A * 11/1943 Zierden ..... 137/355.28
3,970,268 A * 7/1976 Sheetz ..... 242/609.2
4,506,698 A * 3/1985 Garcia et al. ..... 137/355.26
4,534,384 A * 8/1985 Graham et al. ..... 137/899.2
5,787,923 A * 8/1998 Shea et al. ..... 137/355.26
6,199,786 B1 * 3/2001 Lessard et al. ..... 242/406
6,953,049 B2 * 10/2005 Kowalke ..... 137/355.23

* cited by examiner

*Primary Examiner*—John Fox
(74) *Attorney, Agent, or Firm*—Holland & Hart LLP

(57) ABSTRACT

A reel assembly is provided with a hub and opposing flanges that may be disassembled into at least two primary components that may be at least partially nested with one another for compact storage and transport. A stepped or tapered axle is axially received by the hub from only one direction to promote ease of assembly. A mounting plate secures to one end of the axle for mounting the reel assembly to any generally planar surface. A braking system is provided that simply permits free rotational movement of the reel one direction and a drag brake in the opposite direction. A swivel cap of unitized design incorporates retention in the axial and linear directions simultaneously.

22 Claims, 9 Drawing Sheets

REEL ASSEMBLY

BACKGROUND

Reel assemblies are commonly used for storing and using many types of hoses. The common reel assembly design is comprised of a hub, a pair of opposing flanges disposed at the opposite ends of the hub, and an axle upon which the hub may turn. Most reel assemblies leave a manufacturer's location, mostly, if not fully, assembled. This can create a bulky shipment that consumes valued shipping resources. Prior art designs have failed to produce a reel assembly that may be shipped in a compact, disassembled form. Any attempts at such a design have merely created an assembly nightmare for the end consumer. Accordingly, a reel assembly design is needed that permits shipment, storage and sale of the reel assembly in a partially disassembled form. However, such a design should be relatively simple for assembly by end users.

Another common problem found in typical reel assemblies is the fact that the reel assemblies will freely rotate in either direction. Accordingly, when a user pulls hose from the reel assemblies and then stops, the forward momentum of the rotating reel assembly will continue to unreel hose. This can lead to tangling of the hose and simply creates additional reeling for the end user once they are finished using the hose. Braking systems have been previously utilized in various reel assemblies but are either complex in design, which tends to create higher manufacturing costs and propensity for breakdowns, or the braking systems simply provide too little or too much resistance to the unreeling of hose. Furthermore, most prior art braking systems are engaged at all times. Operators must manually disengage such braking systems or reel the hose with the brake engaged. Accordingly, a novel braking system is needed that is simple in design but provides an adjustable measure of braking to the reel assembly, according to a user's needs. Such a braking system should also function so that it is only engaged while the reel is being unreeled.

SUMMARY OF THE INVENTION

This Summary is provided to introduce a selection of concepts in a simplified form that are further described below in the Detailed Description. This Summary is not intended to identify key features or essential features of the claimed subject matter. Moreover, this Summary is not intended for use as an aid in determining the scope of the claimed subject matter.

A preferred reel assembly of the present invention is provided with a hub, having opposite end portions and an exterior surface that is adapted for supporting a length of hose. In one preferred embodiment, the hub is selectively divisible into at least first and second hub members that are each provided with mating surfaces, which engage one another when the hub is disposed in an assembled position. A pair of opposing flanges project radially outwardly from the opposite end portions of the hub to form an annular channel for receiving the hose. An axle is provided, having first and second end portions, coaxial with the hub, and coupled with the hub in a manner which permits selective rotation of the hub about the axle. In one preferred embodiment, the opposing flanges and the first and second end portions are shaped and sized to permit nesting of the structures into a compact form when the reel assembly is at least partially disassembled. In another preferred embodiment, the axle may be provided in a tapered or stepped form that may only be received by the hub in one direction, thus promoting simplicity of assembly.

One preferred embodiment of the reel assembly includes the use of a braking system that allows free reeling in one direction and a drag brake in the opposite direction to prevent self-unwinding of the hose. In still another preferred embodiment, the reel assembly comprises a rotary water union, having a rotor cap of unitized design, which incorporates retention in axial and linear directions simultaneously. While designed for easy removal, the design eliminates the need for separate fastening pins or clips. The design further permits the reel assembly and hose to be easily removed from its point of use for winter storage.

It is therefore a principal object of the present invention to provide a reel assembly that is configured to provide a compact, partially disassembled form for shipping and storage.

A further object of the present invention is to provide a reel assembly that is provided in at least two component parts that are shaped and sized to at least partially nest with one another to provide a compact unit when disassembled.

Still another object of the present invention is to provide a reel assembly that utilizes a tapered or stepped axle that may be axially received within the hub of the reel assembly in only one direction, thus promoting simplicity of assembly.

Another object of the present invention is to provide a reel assembly having a braking system that permits free reeling in one direction and a drag brake in the opposite direction.

A further object of the present invention is to provide a reel assembly having a braking system that is relatively simple in design, while providing adjustability of braking action.

Still another object of the present invention is to provide a reel assembly having a rotary water union with a rotor cap of unitized design that incorporates retention in the axial and linear directions simultaneously.

Yet another object of the present invention is to provide a reel assembly that is relatively simple in design and assembly A further object of the present invention is to provide a reel assembly having a mounting plate that is coupled to one end of the reel assembly axle for securing the reel assembly to nearly any generally planar surface.

These and other objects of the present invention will be apparent after consideration of the Detailed Description and Figures herein.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION

Figure 1:
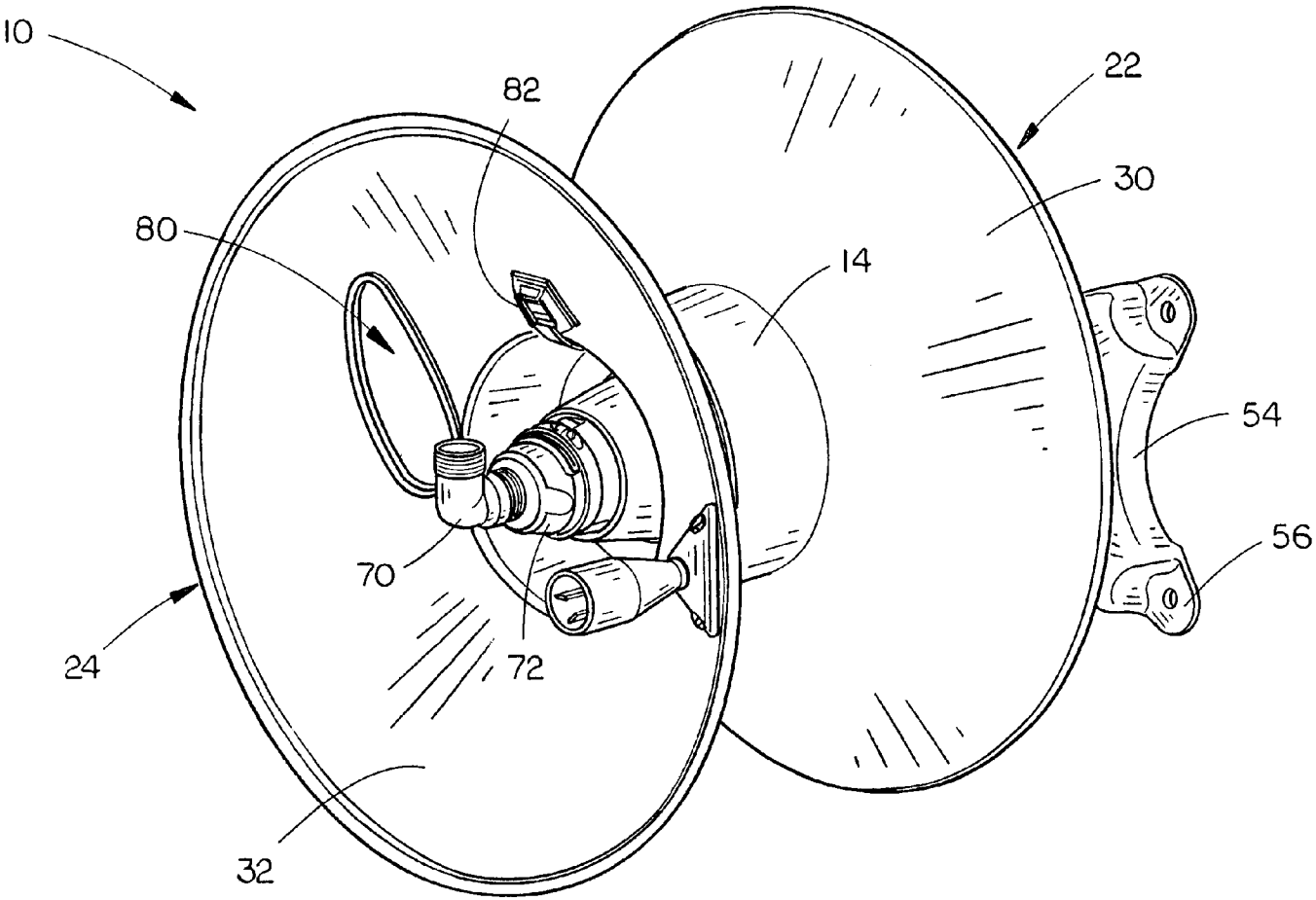
FIG. 1 depicts a perspective view of one embodiment of the reel assembly as the same could be used with an optional mounting bracket.

Embodiments are described more fully below with reference to the accompanying drawings, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The reel assembly 10 of the present invention is provided for use with a hose 12. The reel assembly 10 is generally comprised of a hub 14, having opposite end portions 16 and 18 and an exterior surface 20, which is adapted for supporting a length of the hose 12. In a preferred embodiment, the hub 14 is selectively divisible into at least a first hub member 22 and a second hub member 24. The first hub member 22 and second hub member 24 are each provided with mating surfaces 26 and 28, respectively, which engage one another when the hub 14 is disposed in an assembled position. While the hub 14 depicted in the Figures is shown to be divided along a plane normal to the long axis of the hub 14, it is contemplated that the hub 14 could be separable along a plane that is co-planar with the long axis of the hub 14. A pair of opposing flanges 30 and 32 project radially, outwardly from the opposing end portions 16 and 18 of the hub 14, to form an annular channel for receiving a length of the hose 12. While not depicted, it is contemplated that, in the event that the hub 14 is divided along a plane that is co-planar to the long axis of the hub, the opposing flanges 30 and 32 could similarly be divided at their midpoints.

Figure 5:
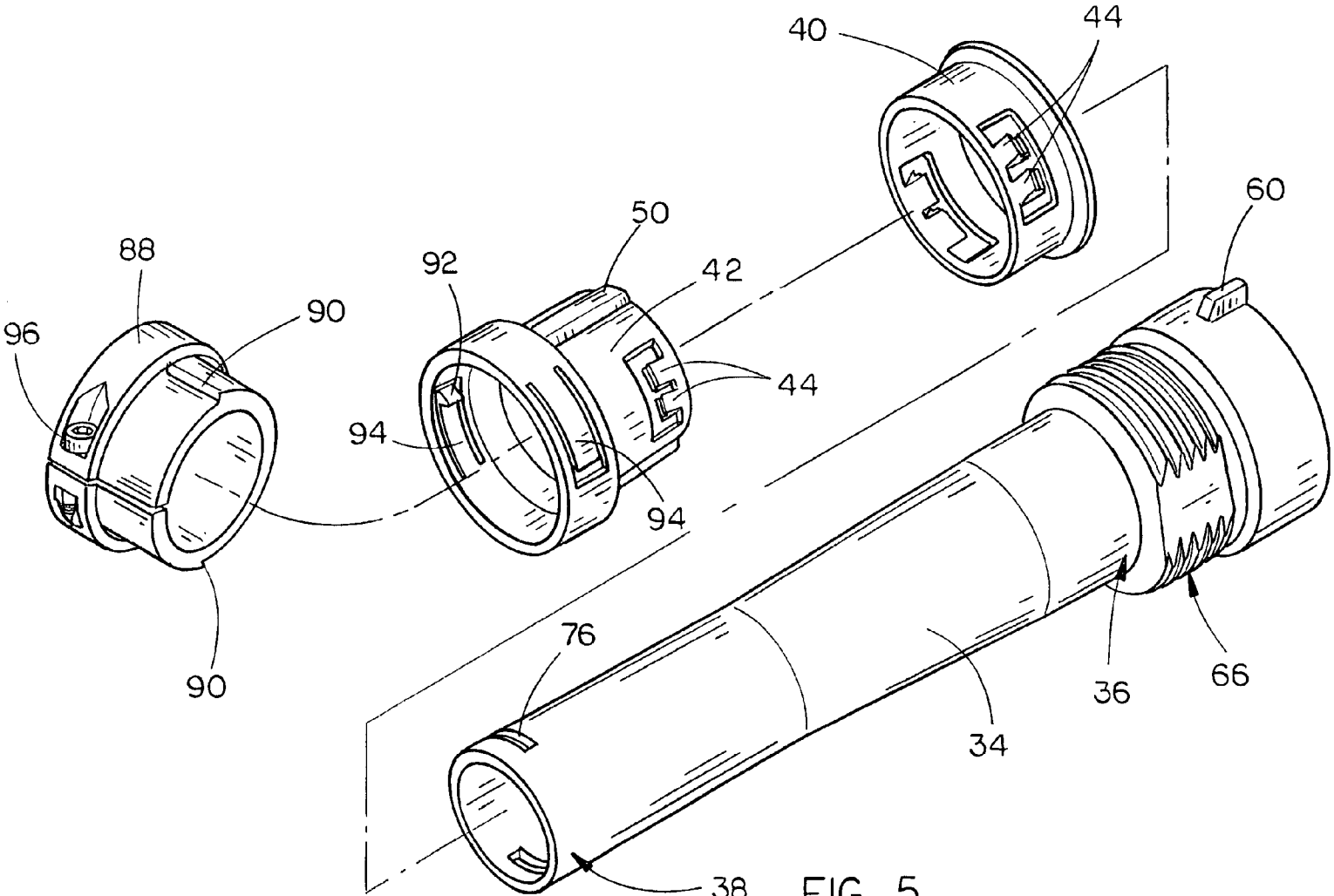
FIG. 5 depicts a partially disassembled, isometric view of one embodiment of an axle, bushings and braking assembly of the reel assembly.
Figure 11:
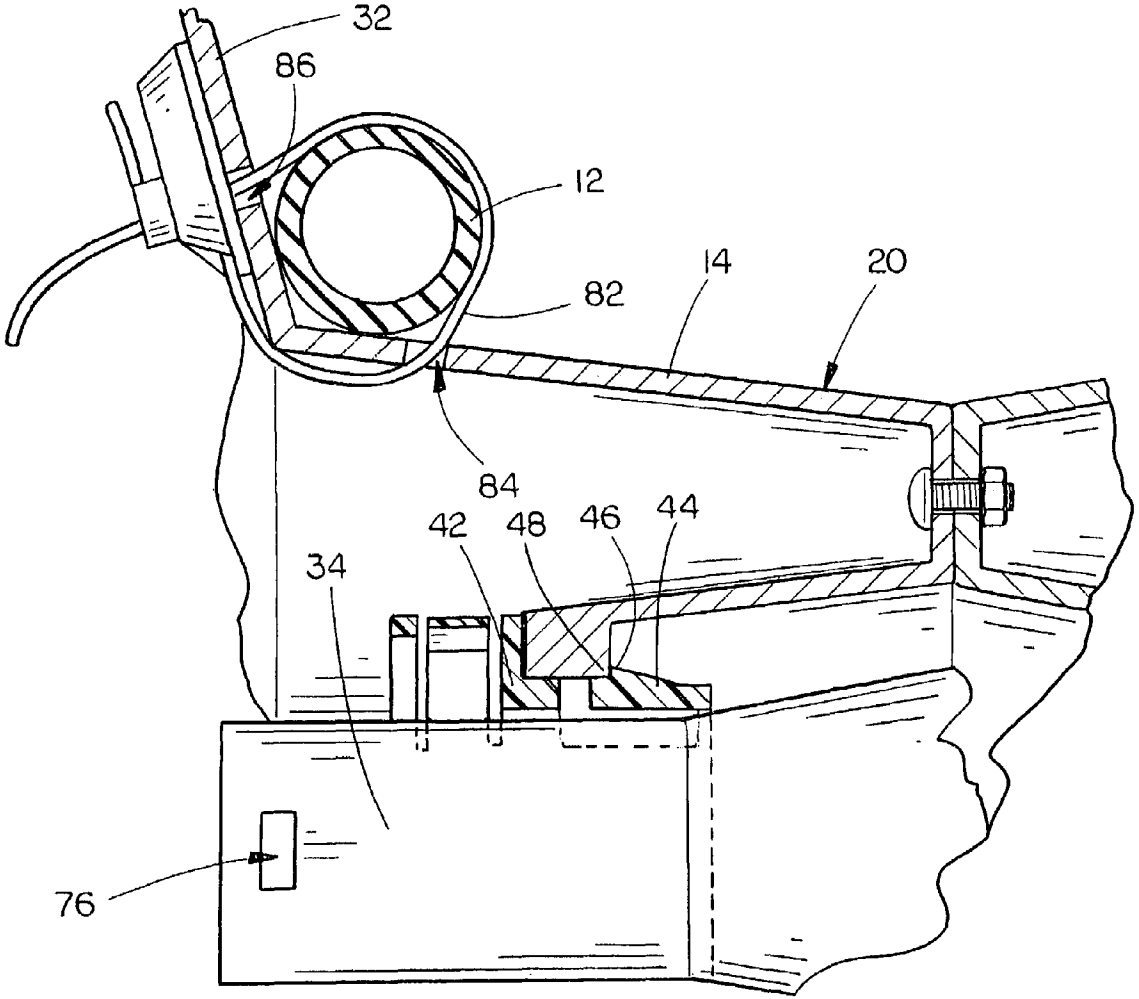
FIG. 11 depicts a partial, cut-away, side elevation view of the hose clamping system depicted in FIG. 10.

An axle 34, having a first end portion 36 and a second end portion 38, is provided to extend co-axially with the hub 14 and be operatively coupled with the hub 14 in a manner that permits selective rotation of the hub 14 about the axle 34. In one preferred embodiment a first bushing 40 and second bushing 42 may be provided to be received adjacent the opposite end portions 16 and 18 of the hub 14 to assist in the rotational movement between the hub 14 and the axle 34. In one embodiment, locking fingers 44 may be positioned adjacent end portions of the first and second bushings 40 and 42, as depicted in FIGS. 5 and 11. The locking fingers 44 may be provided with engagement tabs 46, which are shaped and positioned with respect to the bushings to engage an inner lip 48 of either end portion of the hub 14, as depicted in FIG. 11. In this manner, undesired travel of the first and second bushings along the axle 34 or with respect to the hub 14 is substantially prevented.

To assist in the relative ease with which the reel assembly 10 may be assembled, the axle 34 may be provided to have a shape that is stepped or tapered along its length, leaving the first end portion 36 and second end portion 38 with diameters that are different from one another. In a preferred embodiment, the openings formed through the first bushing 40 and second bushing 42 will be shaped and sized to only properly receive one of the first end portion 36 or second end portion 38 of the axle 34. Likewise, it is contemplated that a preferred embodiment will shape and size the first bushing 40 and second bushing 42 so that they have different outer diameters from one another, so that they may each be properly received by one of the opposite end portions of the hub 14. Accordingly, in this manner, the hub 14, axle 34, first bushing 40 and second bushing 42 may only be properly coupled with one another in one manner. Keys 50 may also be provided along the exterior surface of either bushings that are positioned to mate with keyways 52, formed in one end portion of the hub 14, to ensure that the bushings may only be coupled with their intended end portion of the hub 14. Key 50 further prevents bushing 42 from spinning with respect to the hub 14. By limiting the number of component parts and creating a single manner in which they may properly receive one another, relative ease of assembly is increased greatly. Moreover, assembly is made virtually mistake proof.

Figure 2:
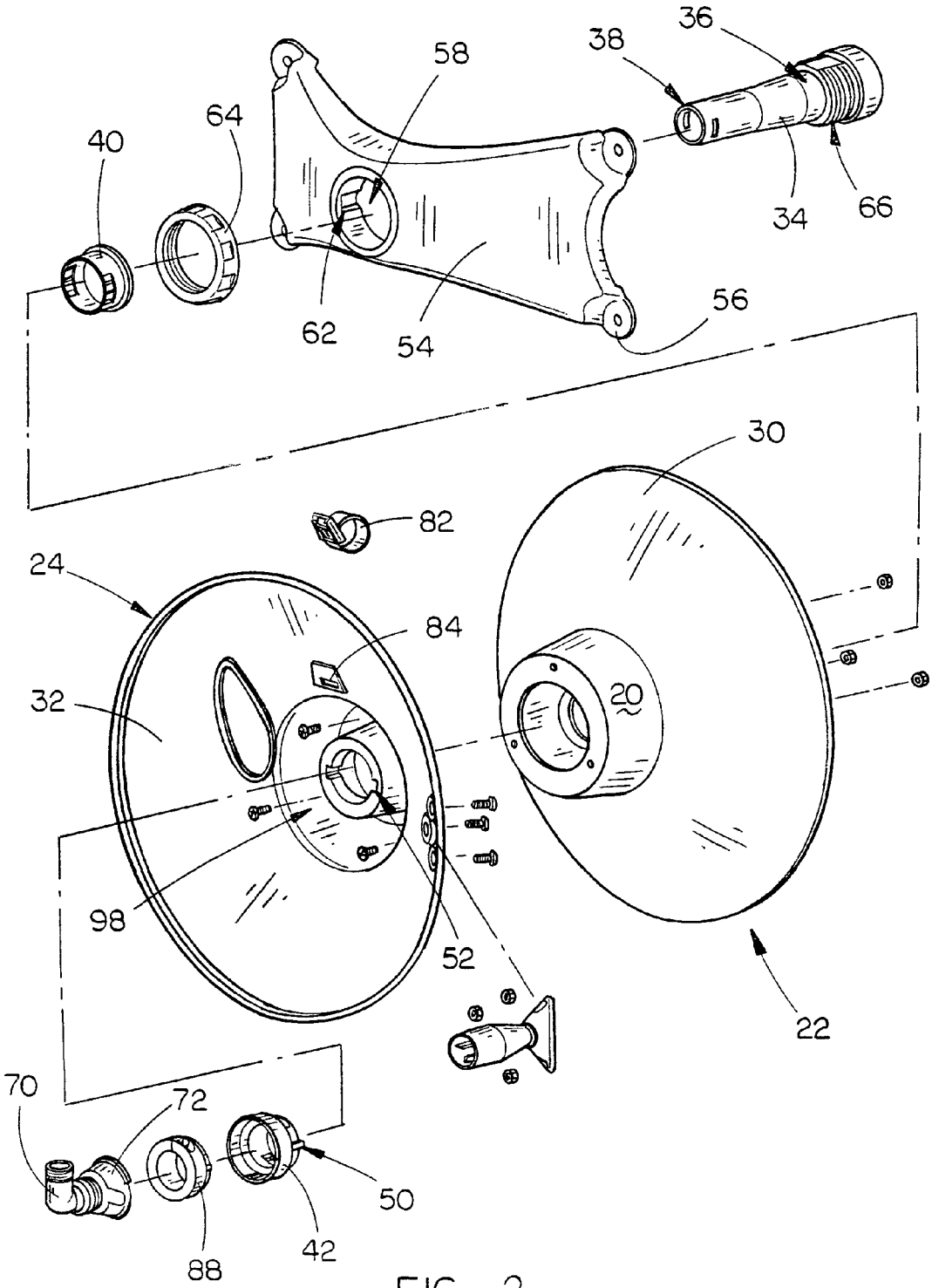
FIG. 2 depicts an exploded view of the reel assembly and mounting bracket depicted in FIG. 1.
Figure 3:
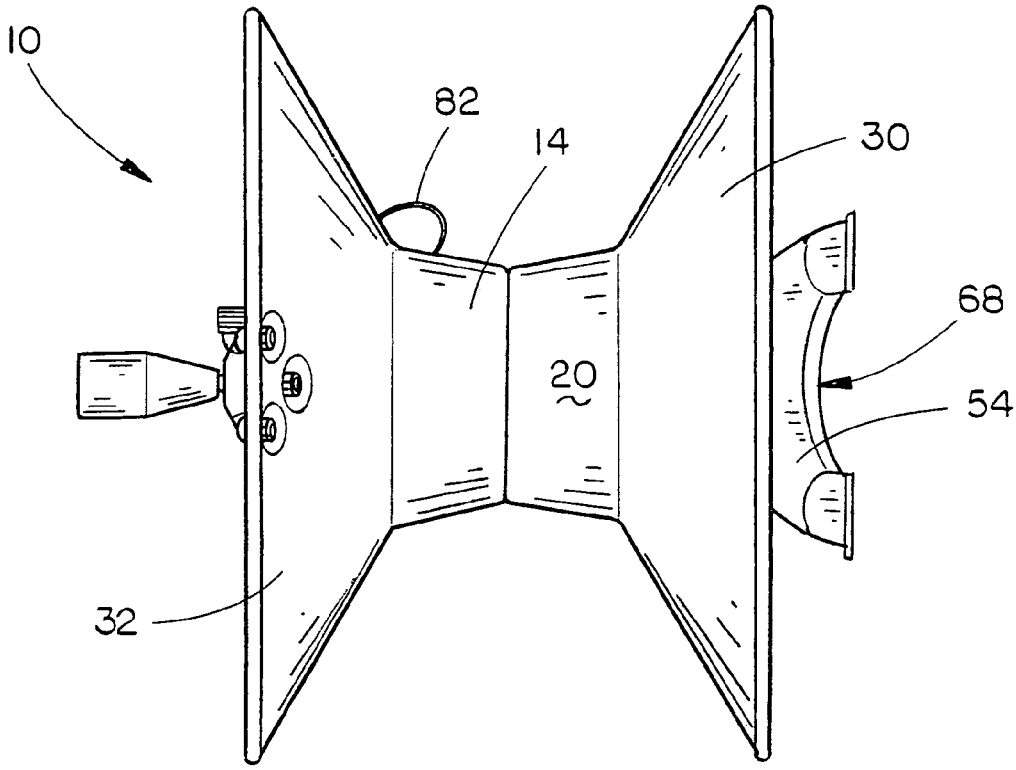
FIG. 3 depicts a front elevation view of the reel assembly and mounting bracket depicted in FIG. 1.
Figure 4:
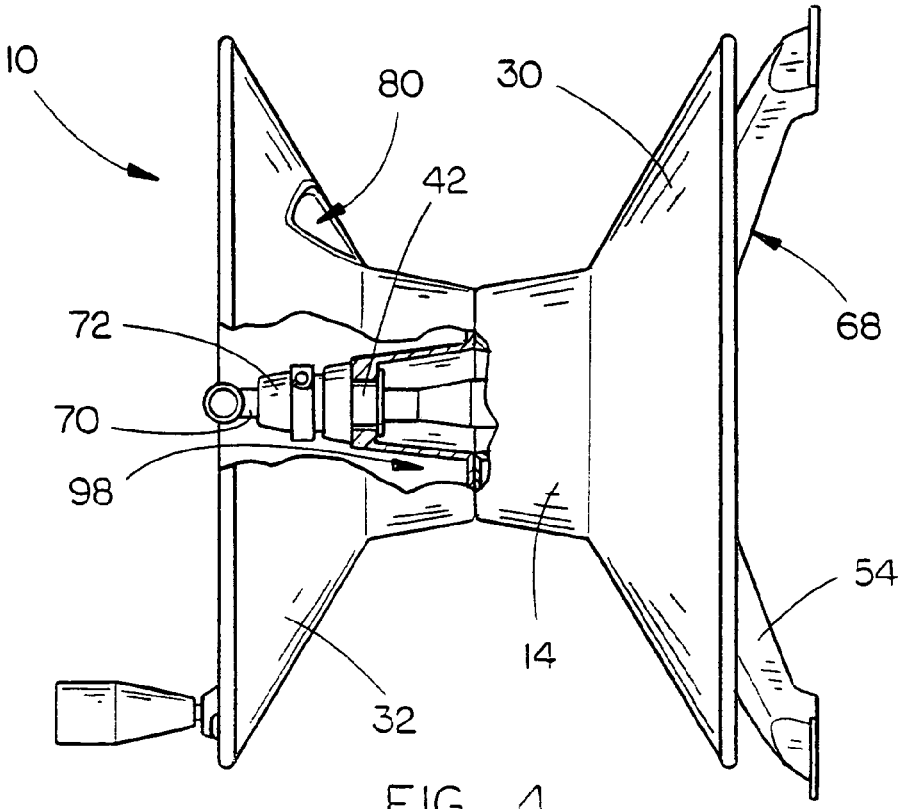
FIG. 4 depicts a partially cut-away, front elevation view of the reel assembly and mounting bracket depicted in FIG. 1.

In one embodiment, the reel assembly 10 may be mounted to any generally planar surface, using a mounting plate 54, such as that depicted in FIG. 2. Mounting tabs 56 and other such commonly known structures may be provided along the mounting plate 54 to secure the mounting plate 54 to the generally planar operating surface, such as a wall or a frame assembly to any portable or stationary device. An opening 58 should be formed through the mounting plate 54 and sized to accommodate the first end portion 36 of the axle 34. A key 60 and keyway 62 may also be provided on the axle 34, adjacent the first end portion 36, and the mounting plate 54, adjacent the opening 58, to ensure one way alignment for ease of assembly and to substantially limit undesirable rotation of the axle 34 with respect to the mounting plate 54. A lock nut 64 may be axially received along the axle 34 to secure the mounting plate 54 adjacent the first end portion 36 of the axle 34. In this manner, the mounting plate 54 is secured between the lock nut 64 and the first end portion 36 of the axle 34. Mating threads 66 may be provided along the axle 34 to receive the lock nut 64 in a secure fashion. Providing the first end portion 36 of the axle 34 with a diameter greater than the diameter of the opening 58 in the mounting plate 54 will ensure that the axle 34 may not be passed completely through the opening 58 as the lock nut 64 is secured.

Figure 6:
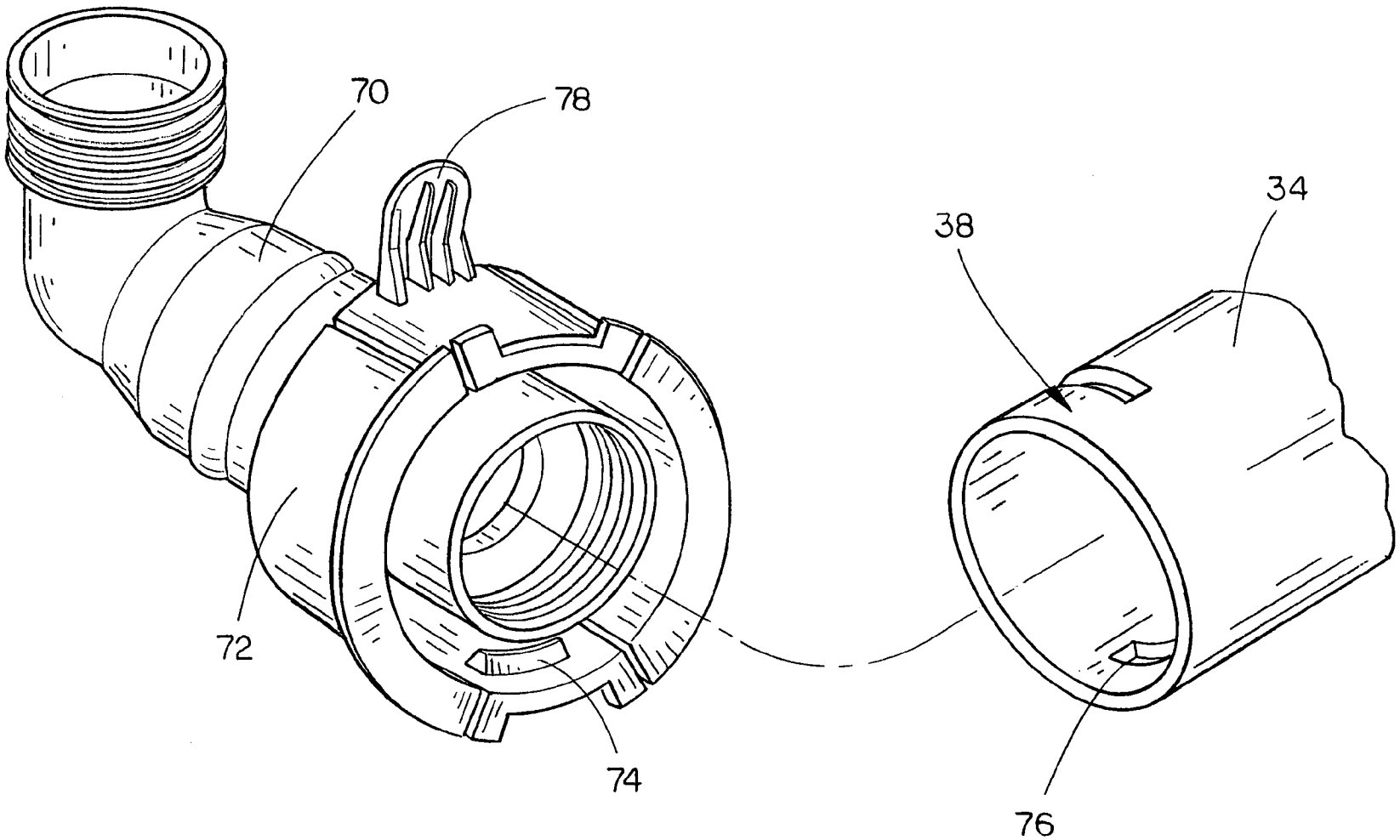
FIG. 6 depicts a partially disassembled, isometric view of on embodiment of a swivel, end-cap and one end of an axle of the reel assembly.
Figure 7:
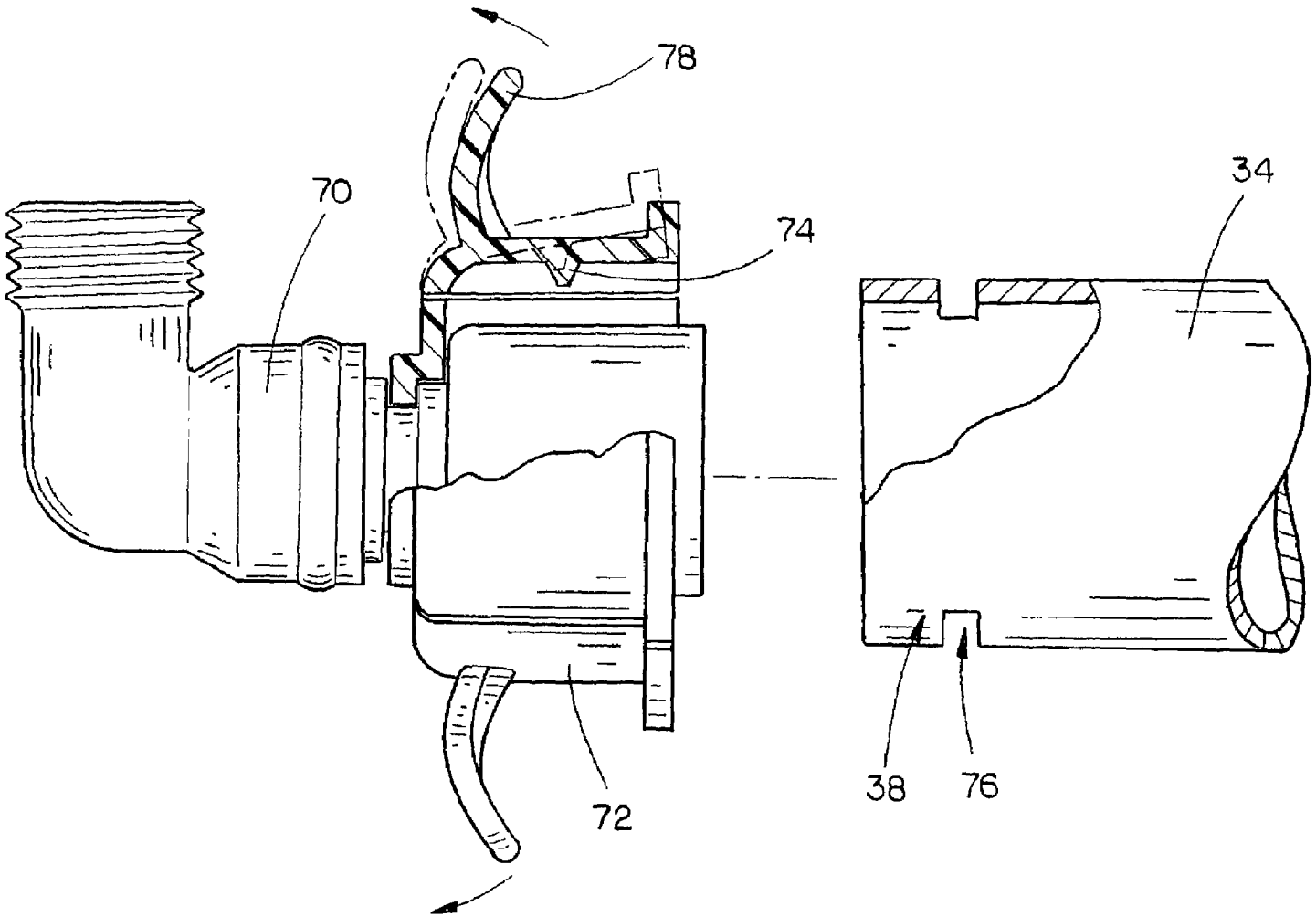
FIG. 7 depicts a partially cut-away, side elevation view of the swivel, enc-cap and axle depicted in FIG. 8.

In one preferred embodiment, the mounting plate 54 is shaped to have a generally concave rearward surface 68 sufficient to provide a passageway for a length of the hose 12 to extend adjacent the generally planar mounting surface and under the mounting plate 54. In this manner, a feed hose (not depicted) may be passed under the mounting plate 54, through its opening 58, and through an open interior portion of the axle 34. An end portion of the hose 12 may then be joined with a swivel fitting 70, such as that depicted in FIGS. 6 and 7. In one preferred embodiment, a swivel cap 72 is disposed around one end portion of the swivel fitting 70. The swivel cap 72 is provided with a pair of locking tabs 74 that are shaped and sized to be releasably received within recesses or openings 76 formed in the second end portion 38 of the axle 34. Accordingly, as depicted FIG. 7, the swivel cap 72 is dimensioned to be received by the second end portion 38 of the axle 34 in manner that aligns the locking tab 74 with the opening 76. In a preferred embodiment, the locking tabs 34 are provided to be generally resiliently deformable, so that they may be selectively removed from the openings 76. Arms 78 may be provided to extend outwardly from the locking tab 74 in a manner that permits manual engagement of the arms 78 to bias the locking tabs 74 outwardly, thus permitting easy removal of the swivel cap 72 from the second end portion 38 of the axle 34. In its assembled position, the swivel cap 72 prevents the hub 14 from being unintentionally removed from the second end portion 38 of the axle 34. The swivel cap 72 further prevents the torque of the distal end of the swivel fitting 70 from twisting the hose 12, which is attached to the opposite end of the swivel fitting 70.

Figure 10:
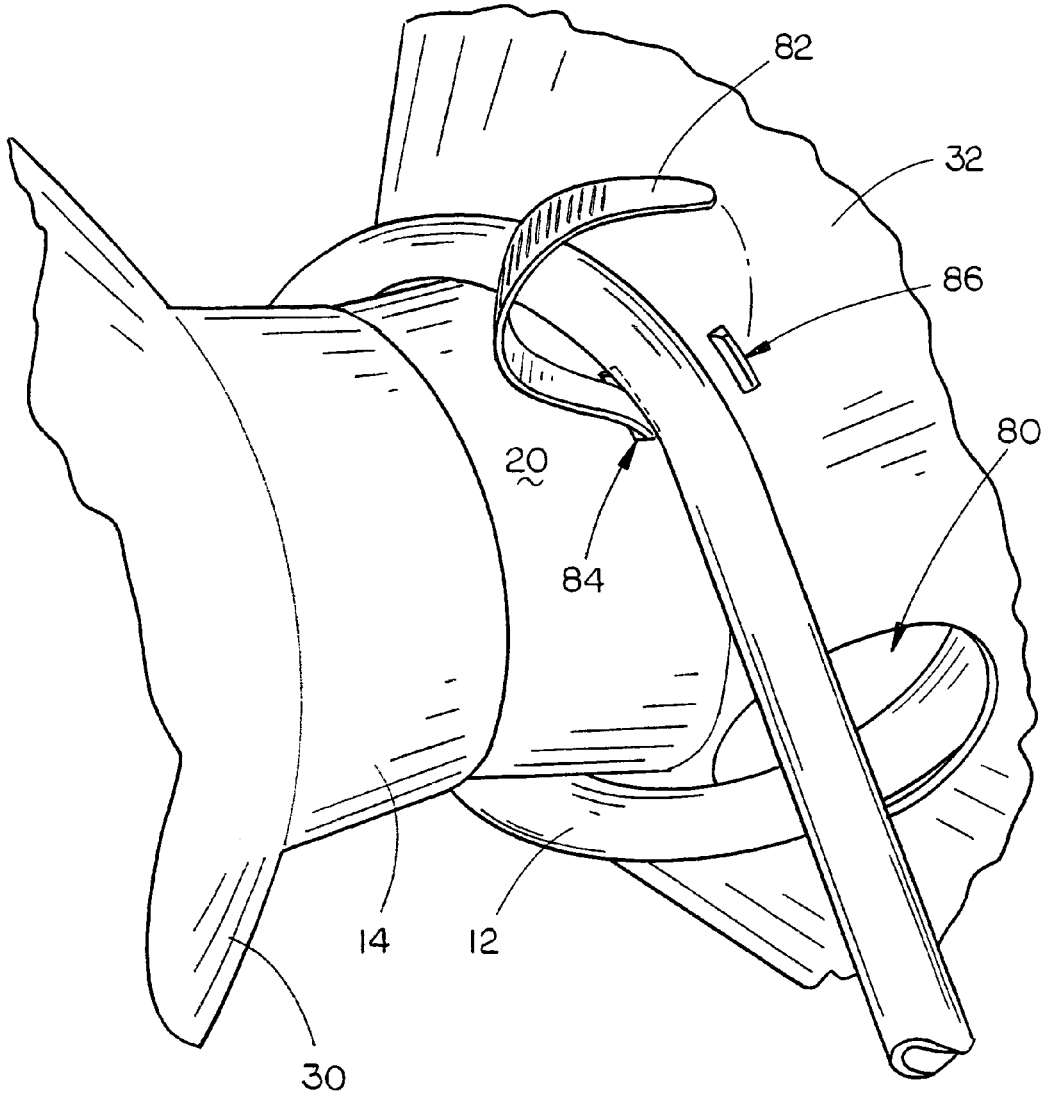
FIG. 10 depicts a partial, isometric view of one embodiment of a hose clamping system of the reel assembly.

An elongated hose 12 may be provided to extend from the distal end portion of the swivel fitting 70, through an opening 80 formed through the flange 32. Once the hose 12 is passed through the opening 80 it may be preferable to secure the hose 12 closely adjacent the flange 32, adjacent the hub 14 to provide an orderly and secure position of the hose 12 adjacent the exterior surface 20 of the hub 14. As depicted in FIGS. 10 and 11, a releasable hose clamp 82 may be passed through a pair of openings 84 and 86 formed through the flange 32 and hub 14, and looped around the hose 12. The free end of the hose clamp may be passed through the hose clamp buckle and tightened accordingly. The flexible and releasable nature of the hose clamp 82 will provide it with a long usable life that permit the removal and replacement of the hose 12 with ease.

Figure 8:
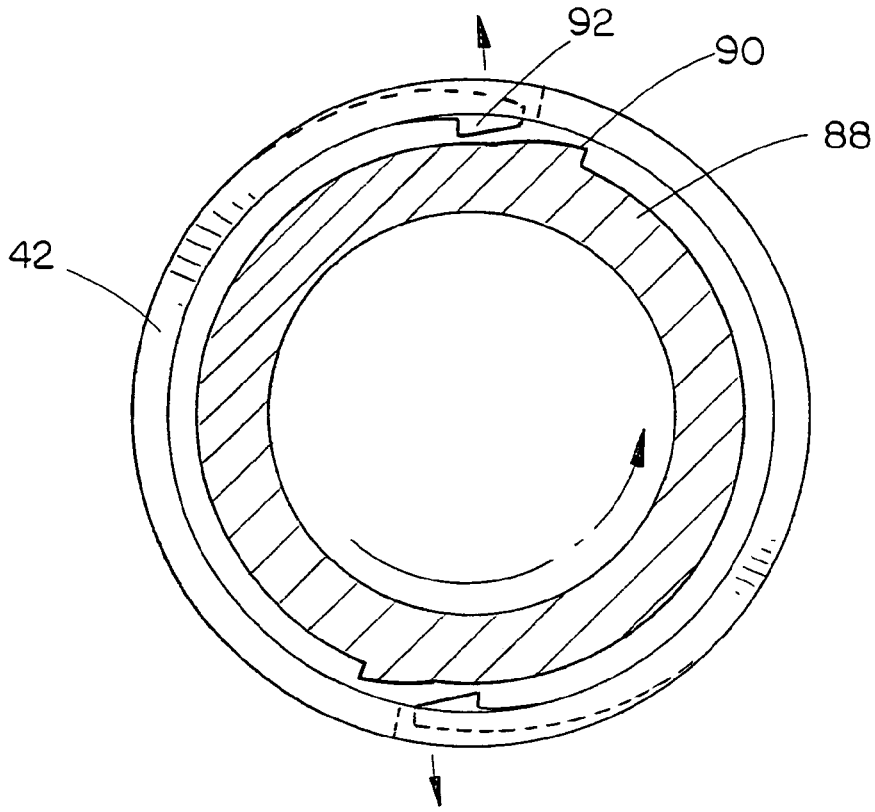
FIG. 8 depicts a partially cut-away, end view of one embodiment of a braking assembly of the reel assembly as it rotates in a braking direction.
Figure 9:
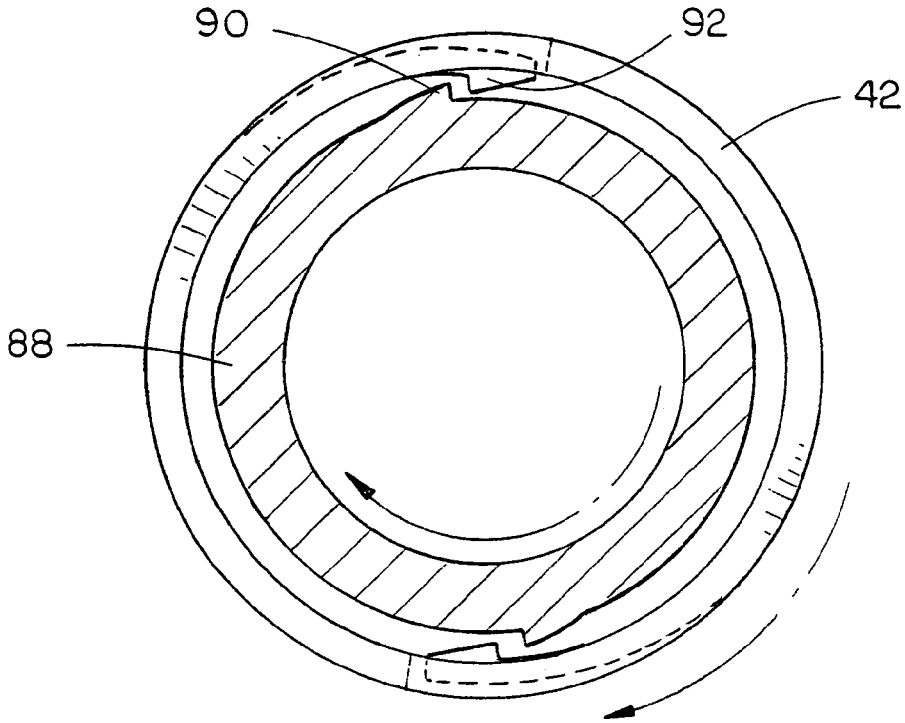
FIG. 9 depicts the braking assembly of FIG. 8 as the same may rotate in a free-reeling direction.

In one embodiment a braking means is operatively coupled with the hub 14 for resisting rotation of the hub 14 with respect to the axle 34 in at least one direction. One contemplated embodiment of the braking means is depicted in FIGS. 5, 8 and 9. Specifically, a braking ring 88 is shaped and sized to be at least partially received by one end portion of the second bushing 42. At least one finger 90 may be provided to extend outwardly from an exterior surface of the braking ring 88. The finger 90 is preferably shaped and positioned to engage at least one tooth 92 formed in an inner surface of the second bushing 42. While variations on the specific design depicted are contemplated, the stepped and tapered design of the fingers 90 engage the teeth 92 when the braking ring 88 and the second bushing 42 are rotated in one direction, as depicted in FIG. 9. In this manner, the braking ring 88 is frictionally drug by the second bushing 42 across the surface of the axle 34, retarding free advancement of the reel assembly 10. However, rotation of the reel assembly in the opposite direction, typically in the reeling direction, the braking ring 88 remains in a fixed position with respect to the axle 34 and the teeth 92 briefly engage the opposite, tapered surfaces of the fingers 90. In one preferred embodiment, the teeth 92 are disposed at the distal ends of resiliently deformable arms 94. Accordingly, as the fingers 90 and the teeth 92 come into contact with one another the arms 94 and teeth 92 are biased outwardly to permit the fingers 90 and teeth 92 to pass one another. This permits the reel assembly to be reeled with minimal resistance. It is contemplated that the braking ring 88 may be split along at least one portion of its circumference, as depicted in FIG. 5. An adjustment screw 96 may be secured to the braking ring 88 across the split in order to permit selective widening and narrowing of the split. In this manner, the inner diameter of the braking ring 88 may be increased or decreased selectively to adjust the level of frictional engagement between the braking ring 88 and the axle 34 as the braking ring 88 is rotated.

It will be desirable to provide the reel assembly 10 in a form that permits a compact, disassembled structure for shipping and storage. Accordingly, in one preferred embodiment, the first hub member 22 and second hub member 24 should be shaped and sized to permit the two components to be nested closely adjacent one another. More specifically, the end portion 16 of the hub 14 may be provided with an open cavity 98 that is shaped and sized to at least partially nest with the mating surface 28 and exterior surface 20 of the second hub member 24 when the hub 14 is disposed in disassembled position. The generally concave outer surface of the flanges 30 and 32, while promoting the nesting function of the reel assembly 10, further provide a cavity beneath the second hub member 24 that may receive some or all of the remaining component parts to the reel assembly 10 when the reel assembly 10 is packaged for shipment or storage.

Although the invention has been described in language that is specific to structural features and/or methodological steps, it is to be understood that the invention defined in the appended claims is not necessarily limited to the specific features or steps described. Rather, the specific features and steps are described as forms of implementing the claimed invention. Since many embodiments of the invention can be made without departing from the spirit and scope of the invention, the invention resides in the claims hereinafter appended.

What is claimed is:

1. A reel assembly for use with a hose, the assembly comprising:

a hub, having opposite end portions and an exterior surface adapted for supporting a length of the hose; said hub being selectively divisible into at least first and second hub members that are each provided with mating surfaces, which engage one another when said hub is disposed in an assembled position;

a pair of opposing flanges projecting radially outwardly from opposite end portions of said hub to form an annular channel for receiving a length of the hose;

an axle, having first and second end portions, coaxial with said hub and operatively coupled with said hub in a manner that permits selective rotation of said hub about said axle; and a mounting plate having an opening, which is shaped and sized to securely receive the first end portion of said axle in a generally perpendicular position with respect to said mounting plate, and a plurality of mounting tabs that are shaped to engage a mounting surface; said mounting plate being disposed substantially along a first plane and said plurality of mounting tabs being substantially disposed along a second plane: said first plane and said second plane being positioned in a spaced-apart relationship with one another such that an access opening is defined by said mounting plate, said mounting tabs; and the mounting surface when said plurality of mounting tabs are engaged with the mounting surface: said access opening being shaped and sized to permit the hose to be passed through said access opening to the first end portion of said axle.

2. The reel assembly of claim 1 wherein the mating surfaces of said first and second hub members are located intermediate the opposite end portions of said hub when said hub is disposed in said assembled position.

3. The reel assembly of claim 2 wherein the mating surfaces of said first and second hub members are generally transversely disposed with respect to a long axis of said hub.

4. The reel assembly of claim 2 wherein said first hub member is provided with an open end cavity that is shaped and sized to at least partially nest with an end portion of said second hub member when said hub is disposed in a disassembled position.

5. The reel assembly of claim 4 wherein said flanges are integrally formed with said hub.

6. The reel assembly of claim 1 wherein the first and second end portions of said axle are provided with diameters that are different from one another.

7. The reel assembly of claim 6 wherein the opposite end portions of said hub are configured to permit said axle to be coaxially disposed within said hub from only one of said opposite end portions of said hub.

8. The reel assembly of claim 6 wherein the opposite end portions of said hub are each provided with bushings that rotatably receive the first and second end portions of said axle; said bushings being provided with diameters that are different from one another.

9. The reel assembly of claim 1 wherein the opening in said mounting plate is shaped and sized to prevent the passage of the first end portion of said axel through said opening.

10. The reel assembly of claim 9 further comprising a nut axially received by said axel to secure said mounting plate adjacent the first end portion of said axel; said mounting plate being disposed between said nut and the first end portion of said axel.

11. The reel assembly of claim 1 further comprising braking means operatively coupled with said hub for resisting rotation of said hub with respect to said axel in a first direction.

12. The reel assembly of claim 1 further comprising a swivel connector operatively coupled to the hose adjacent the second end portion of said axle and a swivel cap disposed around one end portion of the swivel connector; said swivel cap being releasably coupled with the second end portion of said axle.

13. The reel assembly of claim 1 further comprising a releasable hose clamp that loops around the hose to secure it between said flanges.

14. A reel assembly for use with a hose, the assembly comprising:

a hub, having opposite end portions and an exterior surface adapted for supporting a length of the hose; said hub being selectively divisible into at least first and second hub members that are each provided with mating surfaces, which engage one another when said hub is disposed in an assembled position;

a pair of opposing flanges projecting radially outwardly from opposite end portions of said hub to form an annular channel for receiving a length of the hose;

an axle, having first and second end portions, coaxial with said hub and operatively coupled with said hub in a manner that permits selective rotation of said hub about said axle; and braking means operatively coupled with said hub for resisting rotation of said hub with respect to said axel in a first direction;

said braking means being comprised of a braking ring, operatively coupled with said axel and having at least one finger extending outwardly from an exterior surface of said baking ring; said; at least one finger being shaped and positioned to engage at least one tooth formed in an inner surface of a bushing, which is operatively coupled with said hub.

15. The reel assembly of claim 14 wherein said at least one finger is shaped and positioned to engage said at least one tooth when said hub is rotated in said first direction, causing said bushing to drag said braking ring around said axle, while said braking ring is in frictional engagement with said axle.

16. The reel assembly of claim 15 wherein said braking ring is provided with a diameter that is selectively adjustable in a manner that adjusts a level of braking afforded by said braking means.

17. The reel assembly of claim 15 wherein said at least one finger is resiliently deformable and shaped to permit said at least one finger and said at least one tooth to move past one another when said hub is rotated with respect to said axel in a second direction.

18. The reel assembly of claim 14 further comprising a mounting plate having an opening that is shaped and sized to securely receive the first end portion of said axle in a generally perpendicular position with respect to said mounting plate.

19. The reel assembly of claim 18 wherein said plate is shaped to have a generally concave rearward surface.

20. A reel assembly for use with a hose, the assembly comprising:

a hub, having opposite end portions and an exterior surface adapted for supporting a length of the hose; said hub being selectively divisible into at least first and second hub members that are each provided with mating surfaces, which engage one another when said hub is disposed in an assembled position;

a pair of opposing flanges projecting radially outwardly from opposite end portions of said hub to form an annular channel for receiving a length of the hose;

an axle, having first and second end portions, coaxial with said hub and operatively coupled with said hub in a manner that permits selective rotation of said hub about said axle; and a swivel connector operatively coupled to the hose adjacent the second end portion of said axle and a swivel cap disposed around one end portion of the swivel connector; said swivel cap being releasably coupled with the second end portion of said axle; said swivel cap being provided with at least one locking tab that is shaped and sized to be releasably received by the second end portion of said axle.

21. The reel assembly of claim 20 wherein said at least one locking tab is generally resiliently deformable and provided with an arm that is manually engagable to selectively release the second end portion of said axle.

22. A reel assembly for use with a hose, the assembly comprising:

a hub, having opposite end portions and an exterior surface adapted for supporting a length of the hose; said hub being selectively divisible into at least first and second hub members that are each provided with mating surfaces, which engage one another when said hub is disposed in an assembled position;

a pair of opposing flanges projecting radially outwardly from opposite end portions of said hub to form an annular channel for receiving a length of the hose;

an axle, having first and second end portions, coaxial with said hub and operatively coupled with said hub in a manner that permits selective rotation of said hub about said axle; and a releasable hose clamp that loops around the hose to secure it between said flanges; said hose clamp being flexible and provided with a buckle that selectively and releasably receives a free end portion of said hose clamp to permit tightening around the hose.

* * * * *